United States Patent [19]

Nishimoto

[11] 4,380,947

[45] Apr. 26, 1983

[54] PORTABLE ELECTRONIC MUSICAL INSTRUMENT HAVING SEPARABLE CONTROLLING PANEL AND KEYBOARD

[75] Inventor: Tetsuo Nishimoto, Hamamatsu, Japan

[73] Assignee: Nippon Gakki Seizo Kabushiki Kaisha, Tokyo, Japan

[21] Appl. No.: 272,334

[22] Filed: Jun. 10, 1981

[30] Foreign Application Priority Data

| | | | |
|---|---|---|---|
| Jun. 20, 1980 | [JP] | Japan | 55-87357[U] |
| Jul. 2, 1980 | [JP] | Japan | 55-93269[U] |
| Jul. 11, 1980 | [JP] | Japan | 55-97631[U] |
| Jul. 12, 1980 | [JP] | Japan | 55-98555[U] |

[51] Int. Cl.[3] ..... G10C 3/02

[52] U.S. Cl. ..... 84/176; 84/DIG. 3; 84/DIG. 17; 84/354

[58] Field of Search ..... 84/DIG. 3, DIG. 17, 84/171-172, 176-177, 352-354, 423 B, 429, 431

[56] References Cited

U.S. PATENT DOCUMENTS

| | | | |
|---|---|---|---|
| 533,780 | 2/1895 | Bilhorn | 84/354 |
| 776,004 | 11/1904 | White | 84/354 |
| 1,663,238 | 3/1928 | Bilhorn | 84/354 |
| 1,778,885 | 10/1930 | Caruso | 84/354 |
| 2,494,700 | 1/1950 | Gage | 84/177 |
| 2,761,344 | 9/1956 | Koehl | 84/171 |
| 2,974,555 | 3/1961 | Andersen | 84/177 |

FOREIGN PATENT DOCUMENTS

| | | |
|---|---|---|
| 50-10752[U] | 4/1975 | Japan . |
| 52-29122[U] | 3/1977 | Japan . |
| 52-125432[U] | 9/1977 | Japan . |

OTHER PUBLICATIONS

"Guidance for Synthesizer", published by Ongakunotomosha, Dec. 20, 1977.

*Primary Examiner*—Lawrence R. Franklin
*Attorney, Agent, or Firm*—Blakely, Sokoloff, Taylor & Zafman

[57] ABSTRACT

A portable electronic musical instrument is composed of two separable units, that is an upper unit including a controlling panel and a lower unit including a keyboard. For performance, the upper unit is vertically mounted on the lower unit and for portage the upper unit is horizontally mounted on the lower unit to form a portable box like structure. Both side boards of the lower unit are inclined toward the front surface of the keyboard so as not to interfere with performers hands in playing. Base portions of side boards of the upper unit are also inclined towards the keyboard so as to stabilize the upper unit in the performable state.

13 Claims, 9 Drawing Figures

PORTABLE ELECTRONIC MUSICAL INSTRUMENT HAVING SEPARABLE CONTROLLING PANEL AND KEYBOARD

BACKGROUND OF THE INVENTION

This invention relates to a portable electronic musical instrument, and more particularly a portable electronic musical instrument provided with a separable controlling panel and a keyboard.

Various types of electronic musical instruments have been developed which can be classified into the following two types, one being a relatively large size electronic musical instrument of an installed type incorporated with large-scale tone production structures capable of producing variety tones, and the other being a portable type which can be readily handled, transported by hand to any place and easily performed at any time.

Recently there has been a demand for a portable electronic instrument which has the same performance as the large size electronic musical instrument. A typical example is a musical synthesizer. The synthesizer is defined as an electronic musical instrument in which various parameters necessary to form a musical tone can be set as desired by a performer. In the electronic musical instruments of this type which have been developed, if one tries to increase the number of keyboards so as to produce as many tones as possible and to provide a mechanism permitting the setting of as many parameters as possible for the purpose of producing desired tone colors, the portability of the electronic musical instrument has been degraded which makes it difficult to transport. In other words, according to the prior art, a usual electronic musical instrument having high performance and various functions lacks of portability whereas a portable type electronic musical instrument is insufficient in its performance and function.

SUMMARY OF THE INVENTION

Accordingly, it is an object of this invention to provide an electronic musical instrument having a structure which permits a good portability even when the high performance capability and various functions are given to the instrument.

Another object of this invention is to provide a portable electronic musical instrument provided with a separable controlling panel and a keyboard which has a compact construction and can produce variety of musical tones.

Still another object of this invention is to provide an electronic musical instrument having a separable keyboard that can vary performer's touch feeling.

According to this invention, to accomplish these and other objects, there is provided a portable electronic musical instrument comprising a first unit provided with a keyboard including a plurality of keys, and a second unit removable from the first unit and provided with an controlling panel for setting parameters of tone to be produced corresponding to a depressed key and side walls on both side of the controlling panel. Usually, the second unit is vertically mounted on the first unit to provide a performable state, but for portage, the second unit is horizontally mounted on the first unit to form a portable box like structure. The upper edges of the side walls of the first unit are inclined or stepped toward the front end of the keyboard so as not to interfere with the performer's hands in playing the instrument. In some case at the time of performance the first and second units may be mounted on independent tables.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENTS

A preferred embodiment of the electronic musical instrument 1 shown in FIGS. 1 through 4 is a musical synthesizer and comprises a lower unit (first unit) 2, that is the main body of the musical instrument, an upper unit (second unit) 3 and a blind plate 4.

Figure 1:
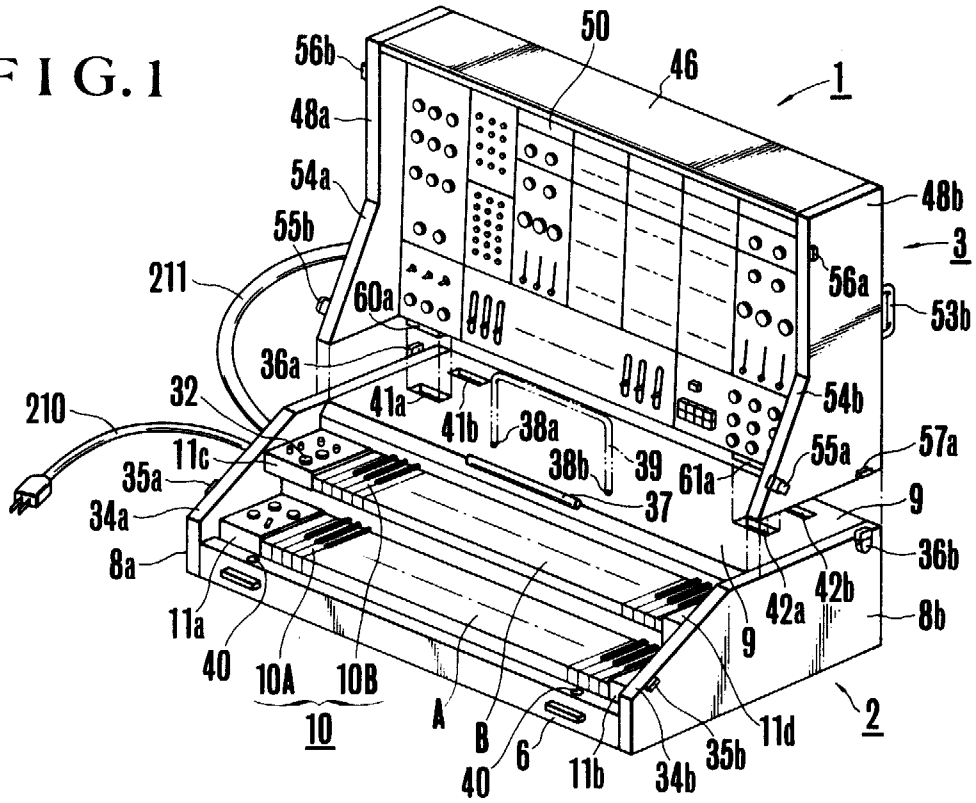
FIG. 1 is a perspective exploded view of one embodiment of a portable electronic musical instrument according to this invention in a performable state.
Figure 2:
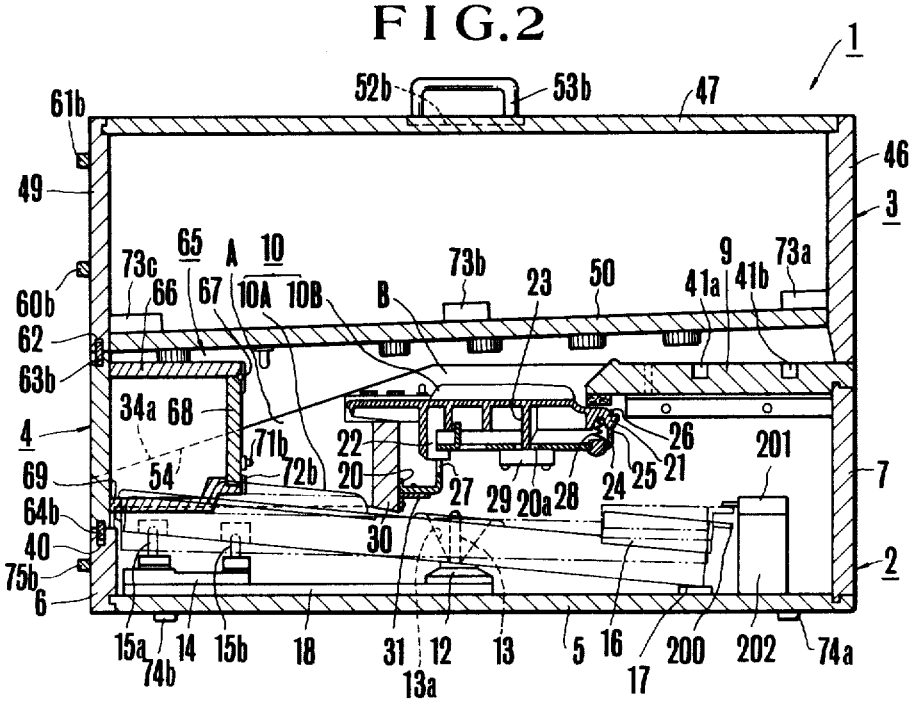
FIG. 2 is a vertical sectional view of the musical instrument shown in FIG. 1 in a contained or portable state.

The upper unit 3 is mounted on the rear portion of the lower unit 2 to form a performable assembly as shown in FIG. 1. By covering the lower unit 2 with the upper unit 3 and the blind plate 4 as shown in FIG. 2, an enclosed box shaped portable musical instrument can be formed.

The lower unit or the main body 2 is formed with a bottom board 5, a front board 6 forming a key slip, a rear board 7, a pair of side boards **8*a* and 8*b* and an upper board 9, and takes the form of a box as a whole. The upper board 9 has a narrow width and positioned at the rear portion so as to open the fore half of the upper portion, and a plurality keys corresponding to respective notes in respective octaves are arranged in two stages in the opened portion. End block members 11*a* through 11*d* are disposed on both sides of the key stages for forming first and second keyboards respectively comprising key groups A and B. Keys 10A of the key group A of the lower keyboard are constructed just like a key mechanism of an ordinary piano as shown in FIG. 2. Substantially the central portion of each key 10A is supported by a balancing pin 13 secured by a balance rail 12 to be swingable in the vertical direction, and the front portion of the key is prevented from moving laterally by oval pins 15*a* and 15*b* mounted on a front rail 14. Under normal or not depressed state, each key 10A is maintained at an inclined state by a weight 16 mounted on the rear end of the key, that is in a state in which the fore end of the key is maintained in a floating state, while the rear end engages a back rail 17. When the fore end of the key is depressed down, a lever 200 secured to the rear end is raised to operate a key switch 201 mounted on a pedestal 202** so as to electrically form and produce a musical tone corresponding to the depressed key.

More particularly, the lower unit 2 comprises a key frame 18 of the keyboard secured to the inner surface of the bottom board 5, the back rail 17, the front rail 14 and the base 12 mounted on the key frame 18, the oval pins 15*a* and 15*b* and a balance pins 13 secured to the front rail 14 and the base 12 respectively, and the weights 16 mounted on the rear end of the keys 10A. Each balance pin 13 penetrates through a funnel shaped opening 13*a* formed at substantially the center of each key 10A so as to permit the key to swing in the vertical direction about the bottom of the funnel shaped opening 13*a*. The upper ends of the oval pins 15*a* and 15*b* are normally received in the recesses on the lower surface of the front end of the key to prevent transverse movement thereof. The weight 16 mounted on each key produces a touch feeling similar to that of a piano. Since the weight 16 is used to provide a touch feeling similar to a piano, an action mechanism utilized in an upright piano or a grand piano may be used instead of the weight 16.

A frame 20 is provided above the central portion of the lower key group A, and the upper key group B is disposed above the frame 20.

The keys 10B of the upper key group B are constructed similar to those of the lower key group A. More particularly, the rear end 21 of each key 10B of the upper keyboard is received in an opening 25 of the vertical rear wall 26 of the frame 20 to swing in the vertical direction, and the key is biased by a coil spring 28 to rotate in the clockwise direction as viewed in FIG. 1. Furthermore, a depending hook 22 is provided on the lower surface of each key near its front end. The hook 22 normally engages an opening 27 of the frame 20 to be swingable in the vertical direction for a small angle. Each key 10B of the key group B is provided with an actuator 23 depending from the central portion of the key, and a key switch 29 is mounted on the lower surface of the frame 20 at a position corresponding to the actuator 23. Accordingly, when a key 10B of the key group B is depressed, the actuator 23 is also depressed downwardly through an opening 20*a* to operate the key switch 29 to produce a musical tone in the same manner as the key group A.

With the construction described above, the same key touch feeling as that of the usual electronic organ can be obtained with the upper key group B, and the same key touch feeling as that of a natural piano can be obtained with the lower key group A so that two key touch feelings can be provided by a single electronic musical instrument thus enabling said instrument to produce a variety of performance.

A vertical plate 30 is supported between two side boards 8*a* and 8*b*. The frame 20 is secured to one side of the plate 30 through a bracket 31. The key group B is formed as keyboard unit by the frame 20, the vertical plate 30, the key switch 29 and the end block members 11*c* and 11*d*. The keyboard unit is incorporated into the lower unit 2 by inserting projections (not shown) on the inner sides of the side boards 8*a* and 8*b* of the lower unit 2 into recesses (not shown) on the lower outer sides of the end block members 11*c* and 11*d* and by abutting the upper surfaces of the rear ends of the end block members 11*a* and 11*b* against the lower end of the vertical plate 30. At the time of transporting the electronic musical instrument, the keyboard unit is positively held by projections, not shown, formed on the inner surfaces of the side boards 48*a* and 48*b* of the upper unit 3.

Various operating knobs 32 such as a tone adjusting variable resistor, push buttons and a power switch are mounted on the upper surfaces of the end block members 11*a* through 11*d*.

The front portions of the upper edges of the side boards 8*a* and 8*b* are slanted at a suitable angle to form inclined surfaces 34*a* and 34*b* which are provided for the purpose of preventing the performer from being interfered by the side boards 8*a* and 8*b*. Fittings 35*a*, 35*b*, 36*a* and 36*b* are secured to the outer sides of the side boards 8*a* and 8*b* near the front and rear sides thereof. These fittings are used for fixing the upper and lower units 3 and 2 with each other into a contained or portable state. The fittings 36*b* and 36*a* are respectively used to engage fittings 57*a* and 57*b* of the upper unit 3 for mounting the same on the lower unit 2 to realize the performable state. Two pairs of rectangular openings 41*a*, 41*b*, 42*a* and 42*b* are provided near both ends of the upper face board 9, and a stop bar 37 is provided at the central portion of the front edge of the upper face board 9 for preventing slippage of a music sheet. Openings 38*a* and 38*b* are formed on the rear side of the opposite ends of the stop bar 37 to receive both legs of substantially U shaped music supporting frame 39 shown by dot and dash lines in FIG. 1. The music supported by the supporting frame 39 is held substantially upright with the lower edge arrested by the stop bar 37. The height of the music supporting frame 39 is adjustable and when it is not used, it is contained in a box for containing various parts of the musical instrument. The height of the front board 6 is reduced so that the front ends of the keys 10A of the lower keyboard project upwardly. On both ends of the upper edge of the front plate 6 are formed openings 40 for receiving pins (to be described later).

The upper unit 3 is shaped as an enclosed box constituted by an upper face board 46, a rear board 47, a pair of side boards 48*a*, 48*b*, a bottom board 49 and an controlling panel 50, and contains a musical tone forming circuit, a control circuit, various electrical component parts, a connector adapted to be connected with an electric cord 211. A cord 210 is adapted for connection to a power supply. Since the embodiment is a synthesizer, an external speaker is used to produce a sound of the instrument which is connected by a cable to the speaker. Of course, a speaker may be incorporated into either the upper unit or the lower unit. Since these electrical circuits and components are well known and immaterial for understanding the instant invention, they are not shown. When combined into a portable state, the upper face board 46 is mounted on the rear board 7 of the lower unit 2. Carrying handles 53*a* and 53*b* which are received in recesses 52*a* and 52*b* of the rear board 47 in the not used state are provided for the upper face board 46.

The front end surfaces of the side boards 48*a* and 48*b* abut against the upper edges of the side boards 8*a* and 8*b* of the lower unit 2 in the portable state. For this reason, the lower portion of the side boards 48*a* and 48*b* are inclined as at 54*a* and 54*b* to respectively fit with the inclined surfaces 34*a* and 34*b* in the portable state. On the other hand, these inclined portions 54*a* and 54*b* serve also to stabilize the upper unit 3 when it is mounted on the lower unit 2 in the performable state. Fittings 55*a* and 55*b* are secured to the lower front edges of the side boards 48*a* and 48*b* to cooperate with aforementioned fittings 35*a* and 35*b* of the lower unit 2. Fittings 56*a*, 56*b*, 57*a* and 57*b* are secured to the side boards 48*a* and 48*b* near the upper front edges and the lower rear edges thereof to cooperate with the fittings 36*a* and 36*b* described above. These fittings 35*a*, 35*b*, 36*a*, 36*b*; and 55*a*, 55*b*, 56*a*, 56*b* engage respectively at the time of combining the upper and lower units 3 and 2 into a portable state, but the fittings 36*a*, 36*b*; and 57*a*, 57*b* engage respectively at the time of the performable state. As the fittings may be used those utilized in trunks or the like so that their detail will not be described.

The bottom board 49 is positioned on the upper face board 9 of the lower unit 2 in the performable state. Two pairs of positioning projections 60*a*, 60*b*, 61*a* and 61*b* which also act as legs in the portable state are formed on the lower surface of the bottom boade 49 at positions corresponding to the rectangular openings 41*a*, 41*b*, 42*a* and 42*b*. Accordingly, when the projections 60*a*, 60*b*, 61*a* and 61*b* are fitted into the openings 41*a*, 41*b*, 42*a* and 42*b* while holding the controlling panel 50 directed forwardly, the upper unit 3 is mounted on the lower unit 2 at a correct upright position and by engaging fittings 36*a* and 36*b* with fittings 57*a* and 57*b* respectively, the upper and lower units 3 and 2 are combined into an integral structure. A pair of pin receiving openings 62*a*, 62*b* are formed on the lower surface of the bottom board 49 near its front edge.

The blind board 4 is used to close an opening defined by the front edges of the frong board 6 of the lower unit 2 and the bottom board 49 of the upper unit 3, and pairs of pins 63*a*, 63*b* and 64*a*, 64*b* are provided on the upper and lower edges of the board 4 at positions corresponding to the openings 62, 62*a*, 62*b* and 40*a*, 40*b*.

Figure 3:
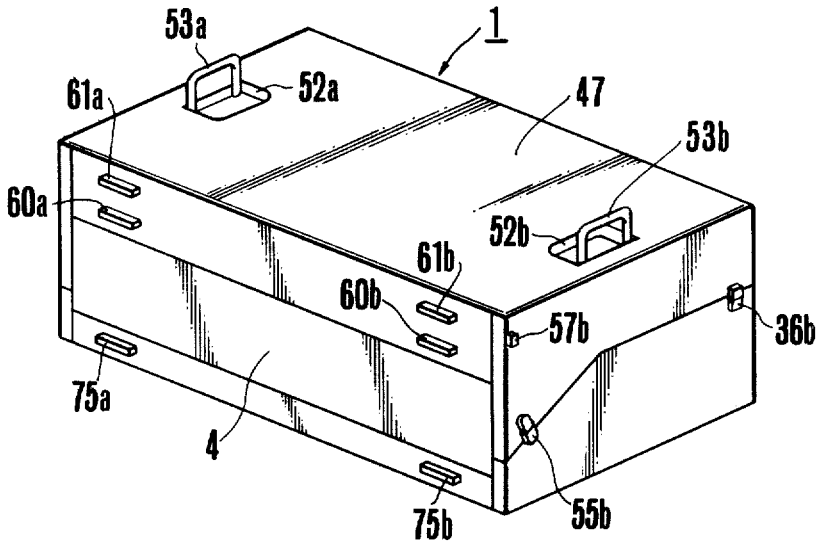
FIG. 3 is a perspective view of the electronic musical instrument in a contained state.

Accordingly, by horizontally mounting the upper unit 3 on the lower unit 2 for transportation, fitting the pins 63, 63*a*, 63*b*, 64*a* and 64*b* into corresponding openings 62*a*, 62*b*, 40*a* and 40*b*, by mounting the blind board 4 between the front board 6 and the bottom board 49 and by engaging the fittings 55*a*, 55*b*, 35*a* and 35*b* with fittings 35*a*, 35*b*, 56*a* and 56*b* respectively, an enclosed box like structure as shown in FIG. 3 can be obtained in which the lower unit 2, the upper unit 3 and the blind board 4 are combined to form a box like structure.

Figure 4:
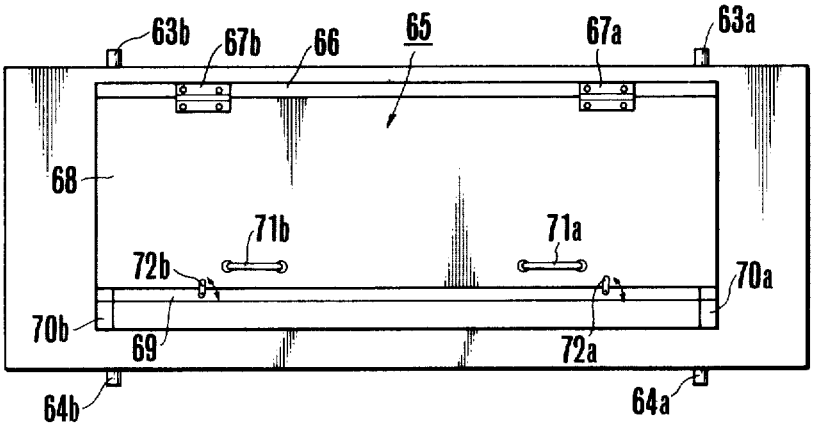
FIG. 4 is a perspective view showing the keyboard clamping member shown in FIG. 2.

A keyboard clamping member 65 is secured to the inner surface of the blind board 4 to extend above substantially the entire length thereof. As shown in FIGS. 2 and 4, the keyboard clamping member 65 takes the form of a box constituted by a horizontal plate 66 with one end secured to the inner surface of the blind board 4, a vertical plate 68 with its upper end pivotally connected to the other end of the horizontal plate 66 by means of a pair of hinges 67*a* and 67*b*, a key clamping plate 69 with one end secured to the inner surface of the blind board 4 and the other end engaged with the lower end of the vertical plate 68, and a pair of side plates 70*a* and 70*b*. As shown in FIG. 2, one end of the key clamping plate 69 located close to the vertical plate 68 is bent to form a hook so as to engage the upper end surface of all keys 10A of the lower key group A thereby holding these keys at lowered positions shown by dot and dash lines, thus preventing free swinging and damage of the keys 10A during transportation. The music supporting frame 39, the music, and the electric cord 210 may be contained in the keyboard clamping member 65. This member 65 may be also used as a box for containing various component parts of the electronic musical instrument. As shown in FIG. 4, there are also provided handles 71*a* and 71*b*, locking members 72*a* and 72*b*, and panel mounting members 73*a*, 73*b* and 73*c* for mounting the controlling panel 50 on the upper unit 3. Legs 75*a* and 75*b* are used to cooperate with legs 60*a*, 60*b*, 61*a* and 61*b* extending in the same direction when the upper unit is contained in the box.

In the performable state key switches in the lower unit 2 are electrically connected to electric circuits in the upper unit 3. Such electric connection can be made by sockets and plugs provided for the lower and upper units 2 and 3 or a cable 211 shown in FIG. 1.

As above described, according to this invention, the electronic musical instrument is constituted by a lower unit 2 containing keyboards, and an upper unit 3 removable from the lower unit 2 and including a controlling panel 50 and electric component parts for producing a musical tone, the upper and lower units being combined into a box like structure for transportion. Moreover, the upper surfaces of the side boards 8*a* and 8*b* between which the keyboards are clamped are inclined so as not to interfere with the performer, and inclined lower portions of the side boards 48*a* and 48*b* of the upper unit 3 stabilize the same when it is vertically mounted on the lower unit 2. This construction permits reduction in the thickness of the box like structure, thereby making compact the electronic musical instrument when the upper and lower units are combined for transportation. Moreover, the keyboard clamping member 65 is used to contain component parts of the electronic musical instrument, thus effectively utilizing the space above the keys.

Figure 5:
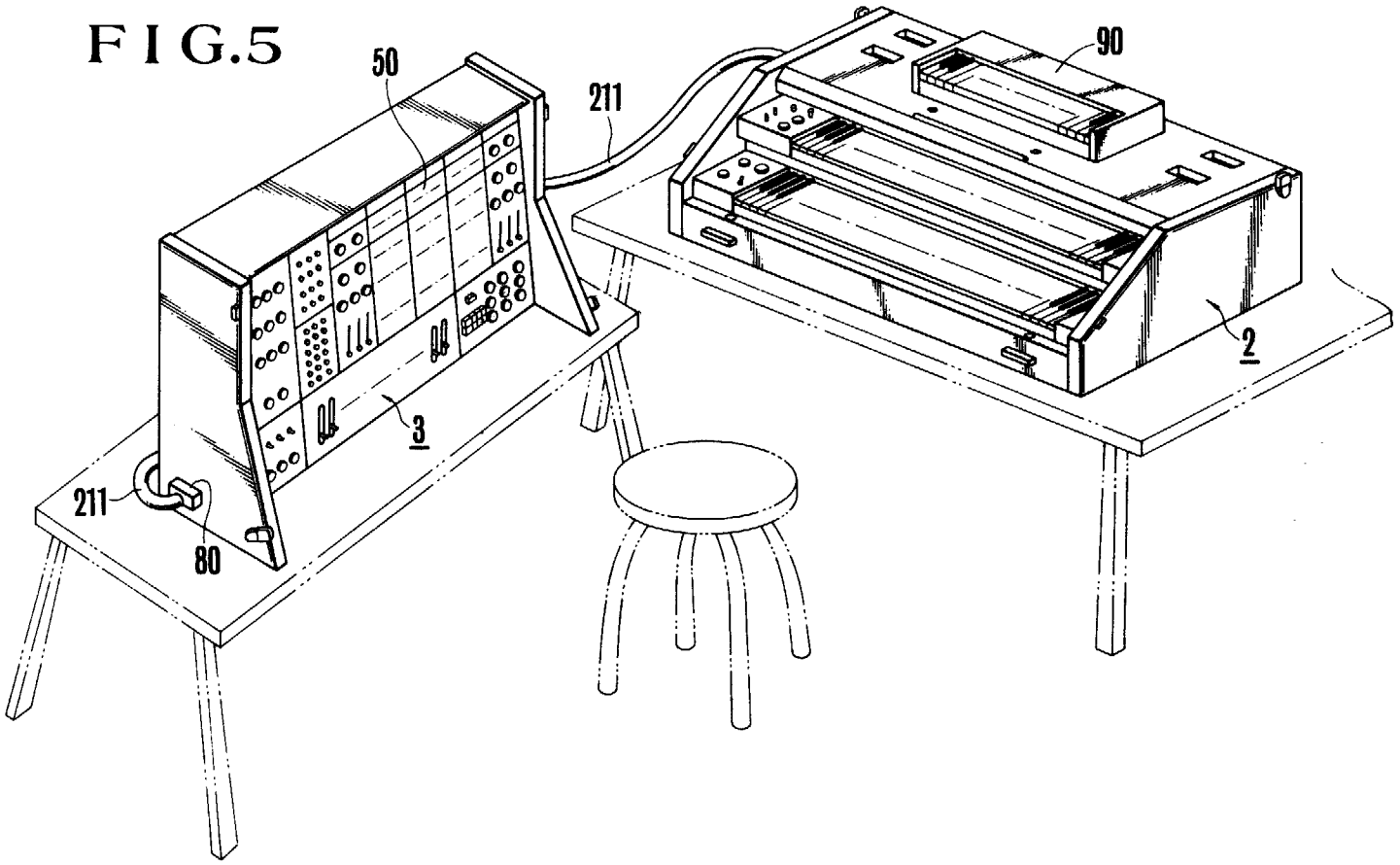
FIG. 5 is a perspective view showing another example of the portable electronic musical instrument of this invention in the performable state.

Instead of vertically mounting the upper unit 3 on the lower unit 2 as shown in FIG. 1, these units can be placed side by side on independent tables as shown in FIG. 5 for establishing the performable state. In FIG. 5, the units 2 and 3 are electrically interconnected by a connector 80 and an electric cable 211. This not only makes easy the arrangement of a plurality of component units of the electronic musical instrument but also permits free motion of the performer. More particularly, another keyboard musical instrument, e.g. a portable music synthesizer 90 can be stacked on top of the unit 2 and further the performer can concentrate his attention to the keyboards without regarding the controlling panel 50 on the unit 3.

Figure 6:
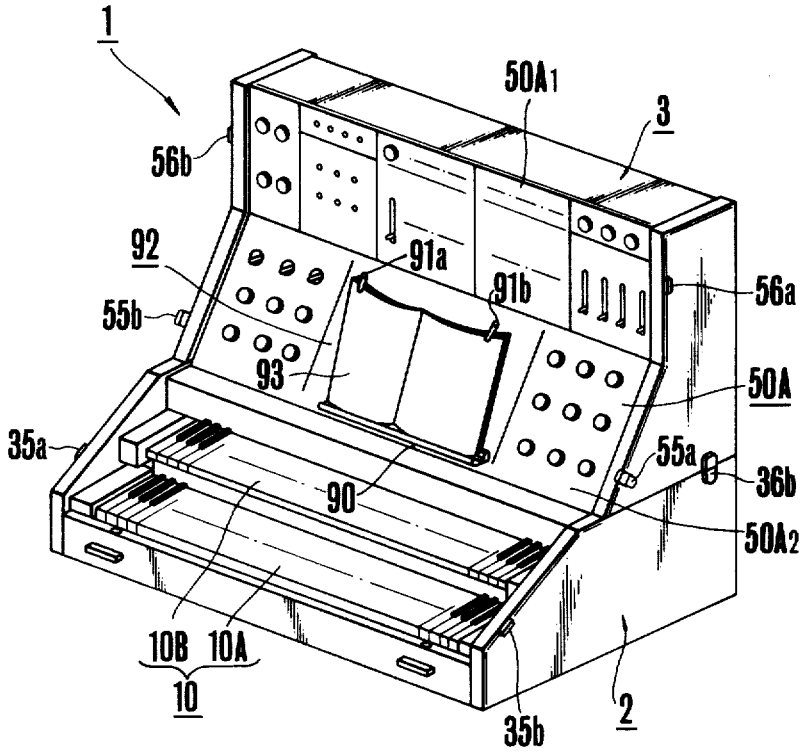
FIG. 6 is a perspective view showing still another example of the portable electronic musical instrument of this invention in a performable state.

FIG. 6 shows another embodiment of the portable electronic musical instrument according to this invention. The lower and upper units 2 and 3 shown in FIG. 3 are slightly different from those described above. For example, the front board 6 is not provided in front of key groups A and B of the lower unit 2, and operating units are not provided on both sides of the key groups A and B. In addition, the controlling panel 50A of the upper unit 3 comprises a substantially vertical panel 50A1 and an inclined panel 50A2 disposed between the panel 50A1 and the lower unit 2. A slip preventing bar 90 and music clamping members 91*a* and 91*b* are provided to form a music support 92 at the central portion of the panel 50A2. This construction is similar to that shown in FIG. 1 so that its description is omitted. With this construction, the surface 93 of the music is held at a position easy to read.

Instead of using well known fittings of the type described above for combining the upper and lower units 3 and 2 into portable state other locking means can also be used, for example rabbit locks.

When combining units 2 and 3 into performable state in the above embodiment, the pins or projections 60*a*, 60*b*, 61*a* and 61*b* of the upper unit 3 are fitted into openings 41*a*, 41*b*, 42*a* and 42*b* of the lower unit 2, but where the pins are not utilized as the legs of the musical instrument in the portable state, the pins and openings may be reversed. It should also be understood that the shape of these pins and openings may be of any desired type.

Figure 7:
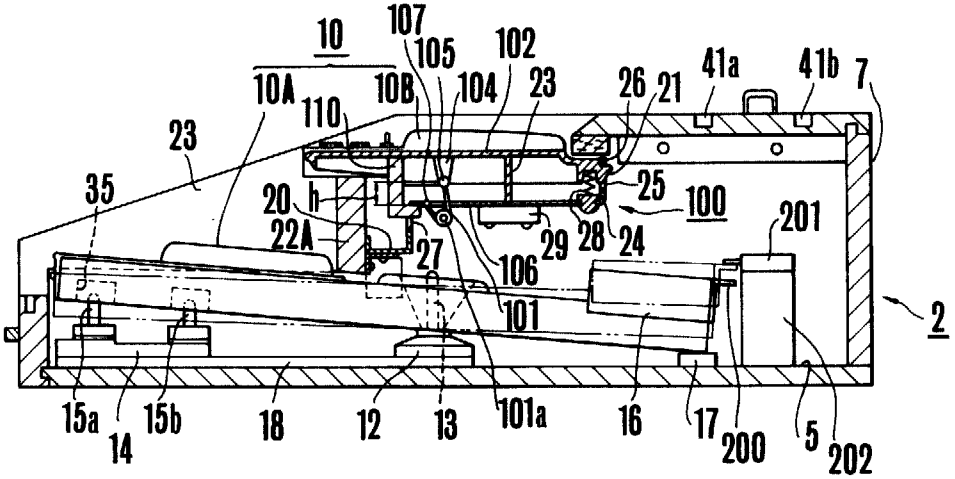
FIG. 7 and FIG. 8 are vertical sectional views showing modified keyboards of the electronic musical instrument.

FIG. 7 is a sectional view showing still another embodiment of the lower unit of this invention in a portable state in which keyboards having keys of different touch feelings are incorporated.

More particularly, this embodiment is different from the foregoing embodiment in that a key mechanism 100 shown in FIG. 7 is constructed to provide a key touch feeling similar to that of a pipe organ wherein the force of the spring 28 is greatly reduced relative to the foregoing embodiment and a twisted coil spring 101 is added. Thus, the spring 28 is used to merely bring a depressed key 102 back to the original position, so that its restoring force may be small. To mount the twisted coil spring 101, a vertical supporting plate 104 is provided at about the center of the bottom of the key 102 and a pin 105 is secured to the lower end of the supporting plate 104. The frame 20 is provided with a perforation 106 at a position corresponding to the supporting plate 104. A pin 107 parallel with pin 105 is secured to one side of the perforation. The pin 105 is positioned obliquely above pin 107 spaced therefrom by a predetermined distance h. The opposite ends of the twisted coil spring 101 are rotatably supported by the pins 105 and 107 so as to hold the coiled portion 101*a* of the spring beneath the perforation 106. The purpose of the twisted coil spring 101 is to provide for the key 102 a predetermined touch feeling, that is a key touch feeling resembling that of a pipe organ and the spring is set to have a predetermined tension. Other elements are identical to those shown in FIG. 2 so that they are designated by the same reference numerals.

When the key mechanism 100 is constructed as above described, so long as the key 102 is not depressed, a hook member 110 engages the upper edge of opening 27 so that the key would be maintained horizontal. At this time, the pin 105 and hence the key 102 is applied with an upward force by the twisted coil spring 101.

Under this state, when key 102 is depressed it is rotated in the counterclockwise direction as viewed in FIG. 7 to lower the supporting plate 104. Accordingly, pin 105 is also lowered to decrease the difference h of height between pins 105 and 107. As this difference h decreases, the vertical component of the force applied to the key by the twisted coil spring 101 decreases, whereas the horizontal component increases. When the key 102 is depressed further to decrease the difference h to zero, the vertical component becomes zero, and the horizontal component becomes maximum.

As the key is further depressed to bring the pin 105 to a position lower than pin 107, the direction of the vertical component is reversed thus applying a slight click to the key. At the same time, the horizontal component decreases to apply a force to the key tending to move it toward right and downward.

Thus only the vertical component has a influence upon the depression of the key and the horizontal component has no influence. As above described, the vertical component decreases as the key is depressed down. As above described, the upper key group 10B affords a key touch feeling resembling that of a pipe organ which is different from that of the key group 10A of the lower stage resembling that of a piano.

As the spring 28 is designed to have a larger repulsive force than the downward force of the twisted coil spring 101, the spring 28 returns a depressed key 102 to the original position when it is released.

The key touch feeling resembling that of a pipe organ can be afforded by other known springs other than the V shaped spring 101. Where it is desired to apply to the key 102 a click feeling various key touch mechanisms utilizing a cam mechanism, a leaf spring, a magnet, etc., may be used as disclosed in Japanese Preliminary Publication of utility model Nos. 29122/1977, dated Mar. 1, 1977, and 125432/1977 dated Sept. 24, 1977, and in Japanese Publication of utility model No. 10752/1975 dated Apr. 4, 1975.

Figure 8:
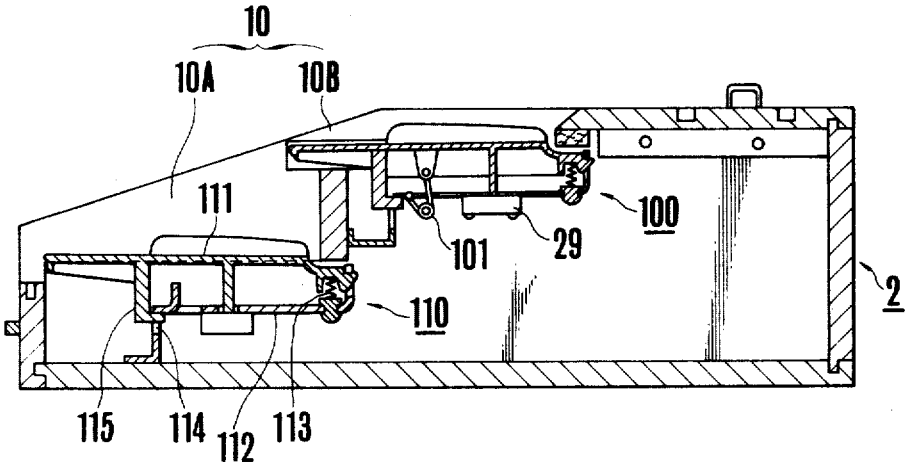

FIG. 8 shows still another embodiment of the lower unit of this invention which is different from that shown in FIG. 7 in that the lower key group 10A shown in FIG. 2 which resembles the key group of a piano is substituted by the key group A shown in FIG. 1. The lower key group 110 shown in FIG. 8 comprises a supporting plate 112 which pivotally supports the rear end of a key 111, a spring 113 applying a restoring force to the key 111, and a L shaped hook 115 which engages an opening 113 of a frame 112 to limit the upward movement of the key. Other elements are identical to those of previous embodiments.

Figure 9:
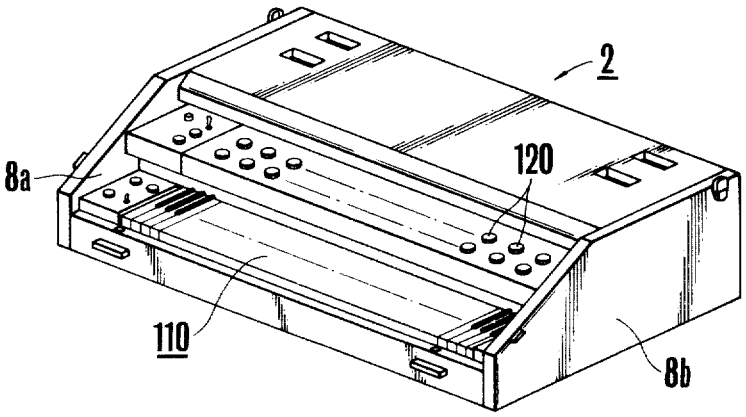
FIG. 9 is a perspective view showing a modified keyboard.

FIG. 9 shows yet another embodiment of the lower unit of this invention in which the upper key mechanism 100 shown in FIG. 8 is substituted by a plurality of push buttons 120 and a plurality of switches operated thereby. Other constructions are the same as those shown in FIG. 8.

While in the foregoing embodiments the upper and lower stage key groups are operated by different key mechanisms it should be understood that the invention is also applicable to three-stage or four-stage keyboard and that keys of single stage may be divided into left and right sections operated by different key mechanisms.

Further, instead of inclining the upper edges of the side plates of the lower unit toward the front end of the keyboard, where upper and lower keyboards are provided at different levels, the upper edges may be cut away to form an L-shaped step thereby to conform with the levels of the upper and lower keyboards so as not to interfere with the performer's hands.

What is claimed is:

1. A portable electronic musical instrument divided into two half units which jointly constitutes said instrument, comprising:

a first unit provided with a keyboard including a plurality of keys; and a second unit detachable from said first unit and provided with a controlling panel for setting parameters of a tone to be produced and side walls on both sides of said controlling panel;

said first and second units having such contours that when they are combined for portage they form a box like structure;

said first unit comprising a front wall and two side walls, the upper edge of each side wall decreasing its height toward said front wall so as not to interfere with a hand of a performer playing said musical instrument.

2. A portable electronic instrument according to claim 1 wherein said second unit further comprises a music supporting member.

3. A portable electronic musical instrument according to claim 1 wherein said first unit is provided with two keyboards having different key mechanisms.

4. A portable electronic musical instrument according to claim 3 wherein said key mechanisms give different key touch feelings.

5. A portable electronic musical instrument according to claim 3 wherein said two keyboards are disposed at different levels.

6. A portable electronic musical instrument according to claim 3 wherein the keys of at least one keyboard are operated by push buttons.

7. A portable electronic musical instrument according to claim 3 wherein the key mechanism of each key of one keyboard comprises a supporting plate for pivotably supporting a rear end of said key, a spring for biasing the key to return to its non-depressed state, and a stop member for limiting rotation of the key, while the key mechanism of each key of the other keyboard includes a weight mounted on a rear end on the key to normally hold the key in a non-depressed upraised state.

8. A portable electronic musical instrument according to claim 3 wherein the key mechanism of each key of one keyboard comprises a supporting plate for pivotally supporting a rear end of said key, a spring for biasing the key to return to its non-depressed state and a stop member for limiting an upward movement of the key, while the key mechanism of each key of the other keyboard includes means for imparting to the key a click feeling.

9. A portable electronic musical instrument according to claim 1 wherein said side walls of said first unit incline toward front end of said keyboard and the lower ends of the side walls of said second unit are inclined toward fore ends so as to stably support said second unit on said first unit. comprises a supporting plate for pivotally supporting a rear end of said key, a spring for biasing the key to return to its non-depressed state and a stop member for limiting an upward movement of the key, while the key mechanism of each key of the other keyboard includes means for imparting to the key a click feeling.

10. A portable electronic musical instrument according to claim 1 wherein said first and second units are provided with cooperating fittings which lock together said first and second units in portable combined state of the instrument.

11. A portable electronic musical instrument according to claim 10 wherein when said second unit is vertically mounted on said first unit to establish performable state, a combination of said fittings different from that for the portable combined state is used.

12. A portable electronic musical instrument comprising a lower unit including a plurality of keys, an upper unit including a controlling panel and vertically mounted on said lower unit to provide a performable state, a blind board, and keyboard clamping means provided for one surface of said blind board, said upper unit being horizontally mounted on said lower unit and said blind board being disposed to close a space defined by a front surface of said lower unit and a bottom surface of said upper unit thereby forming a portable box like structure with said lower unit, said upper unit and said blind board, said keyboard clamping member engaging said key for preventing tilting thereof.

13. A portable electronic musical instrument comprising a lower unit provided with a plurality of juxtaposed keys, an upper unit including a controlling panel and vertically mounted on said lower unit to provide a performable state, and a plurality of fittings secured to outer surfaces of said upper and lower units, at least one of said fittings being used in common when said upper unit is vertically mounted on said lower unit and when said upper unit is horizontally mounted on said lower unit to form a portable box like structure.

* * * * *